United States Patent [19]

Morita

[11] 4,124,662

[45] Nov. 7, 1978

[54] CARBURETOR AND METHOD OF OPERATING SAME

[75] Inventor: Hideo Morita, Yokohama, Japan

[73] Assignee: Nissan Motor Company, Limited, Japan

[21] Appl. No.: 736,078

[22] Filed: Oct. 27, 1976

Related U.S. Application Data

[63] Continuation of Ser. No. 572,065, Apr. 28, 1975, abandoned.

[30] Foreign Application Priority Data

May 2, 1974 [JP] Japan ..... 49-49520

[51] Int. Cl.[2] ..... F02M 3/02

[52] U.S. Cl. ..... 261/41 D; 261/69 R; 261/DIG. 74; 123/DIG. 11

[58] Field of Search ..... 261/41 D, DIG. 74, 69 R; 123/DIG. 11

[56] References Cited

U.S. PATENT DOCUMENTS

| | | | |
|---|---|---|---|
| 2,252,120 | 8/1941 | Ericson | 261/41 D |
| 2,568,987 | 9/1951 | Bruner | 261/41 D |
| 2,796,243 | 6/1957 | McDuffie | 261/41 D |
| 2,991,054 | 7/1961 | Scibbe | 261/41 D |
| 3,330,544 | 7/1967 | Ozersky | 261/41 D |
| 3,331,360 | 7/1967 | Fleming | 261/41 D |
| 3,437,081 | 4/1969 | Mennesson | 261/69 R |
| 3,455,260 | 7/1969 | Mennesson | 261/DIG. 19 |
| 3,517,653 | 6/1970 | Ariga et al. | 123/DIG. 11 |
| 3,554,500 | 1/1971 | Hideg | 261/41 D |
| 3,618,581 | 11/1971 | Simonet | 261/DIG. 74 |
| 3,620,511 | 10/1969 | Reinhardt et al. | 261/41 D |
| 3,678,911 | 7/1972 | Soubis | 123/DIG. 11 |
| 3,690,305 | 9/1972 | Shimada et al. | 261/41 D |

*Primary Examiner*—Tim R. Miles

*Attorney, Agent, or Firm*—Robert E. Burns; Emmanuel J. Lobato; Bruce L. Adams

[57] ABSTRACT

Communication between a low-speed circuit and a main circuit of a carburetor is cut off when the engine is operated at high engine speed and load.

3 Claims, 4 Drawing Figures

CARBURETOR AND METHOD OF OPERATING SAME

This is a continuation of application Ser. No. 572,065, filed Apr. 28, 1975 now abandoned.

BACKGROUND OF THE INVENTION

This invention relates generally to a carburetor for an internal combustion engine and particularly to improvements of the carburetor having therein a main circuit and a low-speed circuit.

It is well known for carburetor to be provided with a main circuit for supplying fuel from a fuel chamber to a main discharge nozzle and a low-speed circuit or an idle system for supplying fuel from the main circuit to a fuel discharge port through which the fuel is supplied into the air-fuel mixture induction passage of the carburetor when the engine is operated at a low engine speed or is idling. With this arrangement, however, difficulties have been encountered in that air passing through the air-fuel mixture induction passage at a high velocity sucks additional air through the low-speed circuit and introduces same into the main circuit when the engine is operated at a high engine speed and load. This additional air flow occurs as a result of the pressure differential in the air-fuel mixture induction passage between the main discharge nozzle and the fuel discharge port of the low-speed circuit. This phenomenon results in shortage of fuel discharged through the main discharge nozzle and therefore lowers the output power of the engine.

SUMMARY OF THE INVENTION

Accordingly, it is an object of the invention to provide an improved carburetor for an internal combustion engine and an improved method of operating the carburetor to overcome the difficulties encountered in the prior art.

Another object of the invention is to provide an improved carburetor and an improved method of operating the carburetor which can prevent the lowering of output power of the engine due to the shortage of fuel discharged from the main discharge nozzle when the engine is operated at high engine speed and load.

A further object of the invention is to provide an improved carburetor and an improved method of operating the carburetor by which communication between the fuel discharge port of the low-speed circuit and the main circuit is cut off to prevent the air flow from the former to the latter when the engine is operated at high engine speed and load.

BRIEF DESCRIPTION OF THE DRAWINGS

Other objects and features of the improved carburetor and the improved method of operating the carburetor according to the invention will become more apparent from the following description taken in conjunction with the accompanying drawings in which like reference numerals and characters designate corresponding parts and elements throughout the drawings in which.

DESCRIPTION OF THE PREFERRED EMBODIMENTS

Figure 1:
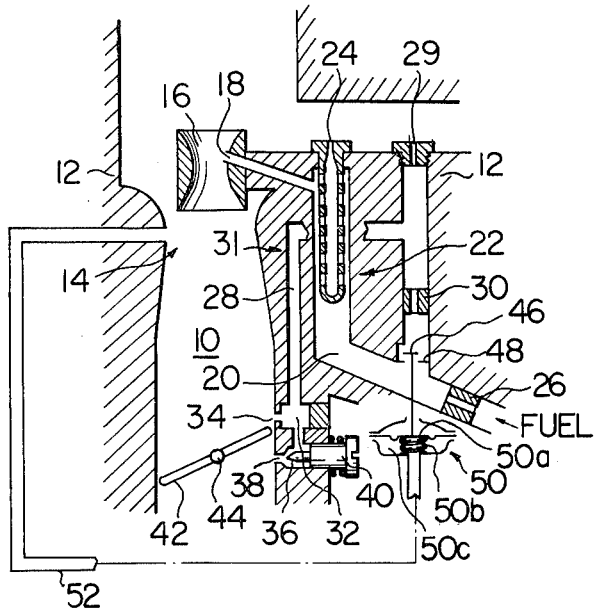
FIG. 1 is a schematic section view of a first preferred embodiment of an improved carburetor in accordance with the invention.

Referring now to FIG. 1, there is shown a first preferred embodiment of a carburetor of an internal combustion engine according to the present invention. The carburetor has an air-fuel mixture induction passage 10 formed within a body casting portion 12 to supply an air-fuel mixture into the cylinders (not shown) of the engine. The mixture induction passage 10 is provided with a main venturi 14 at the inner peripheral portion thereof. Provided upstream of the main venturi 14 is a secondary venturi 16 to which a main discharge nozzle 18 opens. The main discharge nozzle 18 communicates through a passage 20 or a first passage means of a main circuit 22 with a fuel source such as a fuel chamber (not shown). The passage 20 has a main air bleed 24 and a main fuel jet 26 therewithin. A passage 28 or a second passage means of the low-speed circuit 31 branches off from a portion of the main fuel passage 20 between the main air bleed 24 and the main fuel jet 26. The passage 28 has an idle air bleed 29 and an idle fuel jet 30. The passage 28 connects with a progression chamber 32 which communicates through a progression hole 34 with the air-fuel mixture induction passage 10. The progression chamber 32 also communicates with an idle chamber 36 which in turn communicates through an idle port 38 with the air-fuel mixture induction passage 10. Designated by reference numeral 40 is an idling adjustment screw for adjusting the flow rate of mixture through the idle port 38. Disposed adjacent to the progression hole 34 and the idle port 38 is a throttle valve 42 which is fixed to a rotatable throttle shaft 44 and arranged to be rotatably moved within the air-fuel mixture induction passage 10 in response to the movement of an accelerator (not shown).

A normally open valve such as a poppet valve and a valve head 46 and seat 48 therefor are disposed at a portion of the passage 28 adjacent to the passage 20. The valve head 46 is fixedly connected to a diaphragm **50*a* of a diaphragm actuator 50 which diaphragm 50*a* is normally biased by a compression spring 50*b* to urge the valve head 46 to unseat. The vacuum chamber 50*c* of the diaphragm actuator 50 communicates through a conduit 52 with the venturi portion of the air-fuel mixture induction passage 10 which portion is formed by the main venturi 14. The compression spring 50b of the diaphragm actuator 50 is so selected that the valve may be closed by the action of the vacuum created at the venturi portion of the air-fuel mixture induction passage 10** when the engine is operated at a high engine speed and a high engine load.

In operation, when the engine is running at high engine speed and high engine load, an increased vacuum created by the passage of a large amount of air-fuel mixture through the main venturi 14 acts on the diaphragm **50*a* of the diaphragm actuator 50 to move it downwardly compressing the compression spring 50*b* thereof. Then, the valve head 46 fixedly connected to the diaphragm 50*a* is urged into contact with the valve seat 48. Therefore, communication between the progression hole 34 of the low speed circuit 31 and the passage 20 of the main circuit 22 is cut off to prevent the air flow from the progression hole 34 into the passage 20 through the passage 28. When the engine is operated at other than high engine speed and load, the valve is opened to allow communication of the progression hole 34 of the low-speed circuit 31 and the passage 20 of the main circuit 22. Therefore, fuel from the fuel source is supplied into the air-fuel mixture induction passage 10 through the progression hole 34 and the idle port 38** during low engine speed and idling conditions, respectively.

Figure 2:
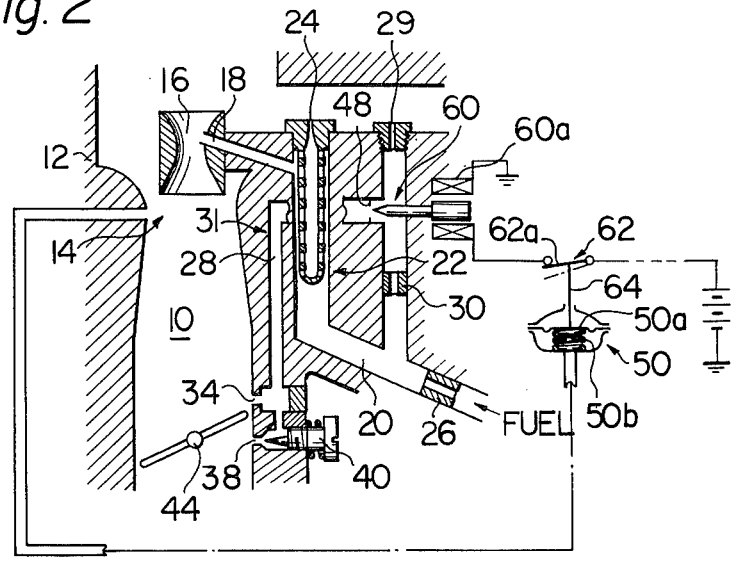
FIG. 2 is a view similar to FIG. 1 but shows a second preferred embodiment of the carburetor in accordance with the invention.

FIG. 2 illustrates a second preferred embodiment of the carburetor of the invention in which a normally open solenoid valve 60 is disposed within the passage 28 of the low-speed circuit 31 and arranged to be closed when the solenoid coil 60*a* therefore is deenergized. The solenoid coil 60*a* is electrically connected to a normally closed on-off switch 62 which is in turn electrically connected to an electric source (no numeral). The movable contact 62*a* of the switch 62 is connected to the diaphragm 50*a* of the diaphragm actuator 50 through a rod 64. The switch 62 is arranged to be opened when the diaphragm 50*a* of the diaphragm actuator 50 is moved downwardly overcoming the biasing force of the compression spring 50*b*. The compression spring 50*b* is selected similarly to that in FIG. 1. The solenoid valve 60 and an electric circuit (no numeral) therefor may be a running-on or dieseling preventing device for the engine which is arranged to close the solenoid valve 60 when an ignition switch (not shown) in the electric circuit is opened.

With the arrangement described hereinabove, when the engine is operated at high engine speed and high engine load, the increased vacuum created near the main venturi 14 acts on the diaphragm 50*a* of the diaphragm actuator 50 to move it downwardly compressing the compression spring 50*b* thereof. Then the movable contact 62*a* of the switch 62 is pulled downwardly by the rod 64 to open the switch 62 to cut off the connection between the electric source and the solenoid coil 60*a* of the solenoid valve 60. Accordingly, the solenoid coil 60*a* is de-energized and the solenoid valve 60 is closed to cut off the communication between the progression hole 34 and the passage 20.

Figure 3:
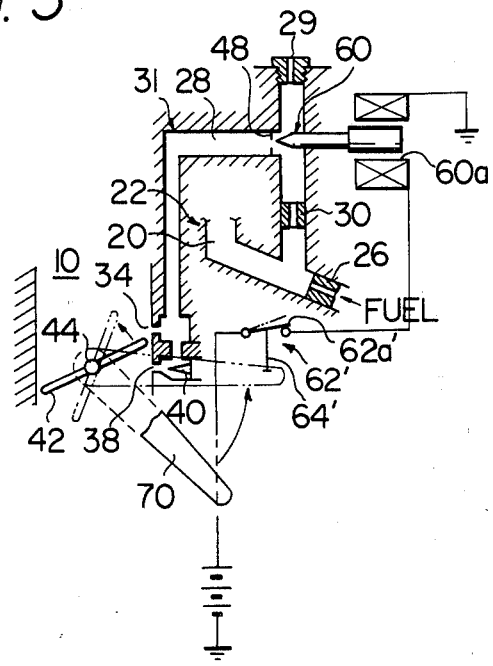
FIG. 3 is a view similar to FIG. 2 but shows a third preferred embodiment of the carburetor in accordance with the invention.

FIG. 3 illustrates a third preferred embodiment of the present invention which is similar to the embodiment shown in FIG. 2 except that a normally closed on-off switch 62' is operated by a lever arm 70 which is fixedly mounted on the rotatable throttle shaft 44 at one end thereof. The switch 62' may be a microswitch. The lever arm 70 is rotatably moved with the throttle shaft 44 in response to the movement of the throttle valve 42. The lever arm 70 is so arranged that the free end thereof pushes the rod 64' and the movable contact 62*a* of the switch 62' up and opens the switch 62' as indicated in phantom when the throttle valve 42 is nearly fully opened as indicated in phantom. The solenoid valve 60 is operated in a similar manner to the instance shown in FIG. 2. Accordingly, when the engine is operated at high engine speed and load, the solenoid valve 60 is allowed to close. While the switch 62' of this instance is operated by the lever arm 70, the switch 62 may be operated by a throttle valve actuating lever (not shown) of the carburetor.

Figure 4:
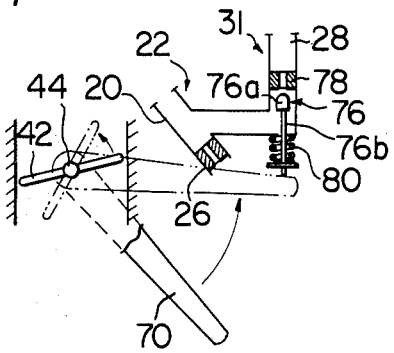
FIG. 4 is a fragmentary schematic section view of a forth embodiment of the carburetor in accordance with the invention.

FIG. 4 illustrates a forth preferred embodiment of the invention in which a normally open spring loaded valve 76 is used for cutting off communication between the progression hole (not shown) of the low-speed circuit 31 and the passage 20 of the main circuit 22. The spring loaded valve 76 is arranged so that the valve head 76*a* thereof contacts a valve seat 78 disposed within the passage 28 overcoming the biasing force of a compression spring 80 and closes the passage 28 when the rod 76*b* of the valve 76 is pushed up by the lever arm 70 fixedly mounted on the rotatable throttle shaft 44. The idle fuel jet 30 may be used as the valve seat 78. The lever arm 70 is operated in a similar manner to that shown in FIG. 3.

As is apparent from the aforementioned description, with these arrangements in accordance with the invention, air flow from the progression hole 34 of the low-speed circuit 31 to the main circuit 22 is prevented. Accordingly, shortage of fuel discharged through the main discharge nozzle 18 is prevented and therefore lowering of the output power of the engine does not occur even when the engine is operated at high engine speed and load.

What is claimed is:

1. A carburetor for use in an internal combustion engine comprising:

means defining an air-fuel mixture induction passage for supplying an air-fuel mixture to the engine, said air-fuel mixture induction passage including a venturi portion;

a throttle valve in said air-fuel mixture induction passage;

means defining a main fuel circuit;

a main discharge nozzle of the main fuel circuit opening upstream of the throttle valve disposed within said air-fuel mixture induction passage of the carburetor;

means defining a low-speed circuit;

said main fuel circuit having a first passage providing in use communication for the main discharge nozzle with a fuel source;

a progression chamber in the low-speed circuit, having a progression hole providing communication of the progression chamber with the air-fuel mixture induction passage, said progession hole being located above the edge of the throttle valve at the fully closed position thereof;

said low-speed fuel circuit having a second passage providing communication for the progression chamber with said first passage;

valve means for closing said second passage to block communication between said first passage and the progression chamber when actuated;

a diaphragm-actuator for actuating said valve means upon having a venturi vacuum signal applied thereto corresponding to a high engine speed and load operation condition; and conduit means defining a passage for providing communication for said diaphragm-actuator with the venturi portion of said air-fuel mixture induction passage for applying to said diaphragm-actuator the venturi vacuum signal generated at the venturi portion, said passage being formed separate and independent from the main discharge nozzle and said first passage of said main fuel circuit and said second passage of said low-speed fuel circuit.

2. A carburetor as claimed in claim 1, in which said valve means includes a normally open diaphragm-actuated valve disposed within said second passage and mechanically connected to said diaphragm actuator.

3. A carburetor as claimed in claim 1, in which said valve means includes a normally open solenoid-actuated valve disposed within said second passage and arranged to close said second passage when its solenoid coil is deenergized, said carburetor further comprising a normally closed switch means electrically connecting the solenoid coil of said normally open solenoid-actuated valve to an electric source and operative for deenergizing the solenoid coil of said solenoid-actuated valve when actuated, and means for connecting said normally closed switch means mechanically to said diaphragm actuator for actuating said normally closed switch means.

* * * * *